US006167809B1

(12) United States Patent
Robinson et al.

(10) Patent No.: US 6,167,809 B1
(45) Date of Patent: Jan. 2, 2001

(54) ULTRA-MINIATURE, MONOLITHIC, MECHANICAL SAFETY-AND-ARMING (S&A) DEVICE FOR PROJECTED MUNITIONS

(75) Inventors: Charles H. Robinson, Silver Spring; Robert Wood, Laurel, both of MD (US)

(73) Assignee: The United States of America as represented by the Secretary of the Army, Washington, DC (US)

( * ) Notice: Under 35 U.S.C. 154(b), the term of this patent shall be extended for 0 days.

(21) Appl. No.: 09/192,805

(22) Filed: Nov. 5, 1998

(51) Int. Cl.[7] ..... F42C 15/26; F42C 15/00
(52) U.S. Cl. ..... 102/235
(58) Field of Search ..... 102/247, 248, 102/249, 251, 254, 255, 256, 235, 231, 234, 233

(56) References Cited

U.S. PATENT DOCUMENTS

| | | | | |
|---|---|---|---|---|
| 2,475,730 | | 7/1949 | Wandrey | 102/247 |
| 2,710,578 | | 6/1955 | Rabinow | 102/247 |
| 4,195,575 | * | 4/1980 | Deuker et al. | 102/232 |
| 4,284,862 | | 8/1981 | Overman et al. | 200/61.45 R |
| 4,770,096 | | 9/1988 | Maruska et al. | 102/233 |
| 4,793,257 | | 12/1988 | Bolieau | 102/221 |
| 4,815,381 | * | 3/1989 | Bullard | 102/247 |
| 4,891,255 | | 1/1990 | Ciarlo | 428/131 |
| 4,986,184 | * | 1/1991 | Kude | 102/256 |
| 5,705,767 | * | 1/1998 | Robinson | 102/231 |

* cited by examiner

*Primary Examiner*—Thomas Price
(74) *Attorney, Agent, or Firm*—Paul S. Clohan, Jr.; Mark D. Kelly

(57) ABSTRACT

An ultra-miniature, monolithic, mechanical safety and arming (S&A) device for projected munitions operates in accordance with a double interlock feature. Acceleration of the projected munition moves a delay slider into a final position, causing an arming slider and a safety interlock slider (in a first embodiment) or a command slider (in a second embodiment) to become partially disengaged. In the first embodiment, a command received by the safety interlock slider then moves it out of the way of the arming slider, thereby permitting the arming slider to move into its armed position. In the second embodiment, a command received by the command slider then moves it out of the way of the arming slider, thereby permitting the arming slider, under spring force, to move into its armed position.

22 Claims, 15 Drawing Sheets

ULTRA-MINIATURE, MONOLITHIC, MECHANICAL SAFETY-AND-ARMING (S&A) DEVICE FOR PROJECTED MUNITIONS

BACKGROUND OF THE INVENTION

1. Field of the Invention

The present invention generally relates to an ultra-miniature, monolithic, mechanical safety-and-arming (S&A) device for projected munitions. More specifically, the invention relates to an ultra-miniature, mechanical, artillery-fuze S&A device based on commercial microelectromechanical systems (MEMS) technology.

2. Description of the Prior Art

Explosive projectiles, such as mortar shells, artillery shells and other similar projectiles, normally have an S&A device which operates to permit detonation of the explosive only after the projectile has been fired or launched. Thus, mechanical arming delay mechanisms for such projectiles or explosives are well-known in the art.

For example, three-dimensional rotary or linear zig-zag delay (i.e., inertial delay) devices on the scale of millimeters or centimeters, fashioned by precision machining, casting, sintering or other such "macro" means, have served the purpose of providing a mechanical delay before closing a switch, or removing a lock on a detonator slider in a fuze S&A device. Such devices are disclosed, by way of example, in U.S. Pat. No. 4,284,862 and U.S. Pat. No. 4,815,381.

However, the fabrication of such devices is costly in that the devices are required to be constructed of extremely precision components, often requiring time-consuming sorting of components, which limits the use of these types of devices. In recent years, the LIGA (Lithographie, Galvanoformung, Abformung, for "lithography, electroplating, molding") micromachining technique has evolved as a basic fabrication process for the production of a large variety of microstructure products utilizing metals, polymers and even ceramics. The extreme precision of the microstructure products resulting from this technique, in combination with other advantages of the technique, has opened a broad field of application for the fabrication of sensors, actuators, micromechanical components, microoptical systems, and electrical and optical microconnectors.

With the latter considerations in mind, a miniature, planar, inertially-damped, inertially-actuated delay slider actuator micromachined on a substrate and consisting of a slider with a zig-zag or stair-step-like pattern on the side edges was developed. That device was disclosed in U.S. Pat. No. 5,705,767, which is assigned to the assignee of the present invention.

Other mechanical arming delay mechanisms include sequential falling leaf-spring mechanisms and escapement mechanisms. The technology surrounding such devices also includes rotors or sliders which, as arming proceeds, move out-of-line fire-train components toward and into an in-line position. Typically, the out-of-line element is a detonator or squib (propellant initiator). In such devices, the rotor or slider can remove an explosive barrier that has blocked function of the fire train, thereby arming the device.

Finally, such devices also include arrangements wherein mechanical sequential interlocks control the motion of the slider/rotor such that an out-of-sequence actuation of the interlocks leads to a fail-safe condition. An example of out-of-sequence actuation is a spin lock releasing an arming slider before a setback lock has functioned to release the arming slider.

Overall, prior art arrangements are such that mechanical fuze S&A devices comprise complicated, three-dimensional assemblies of piece-parts working together inside of a frame, collar or support housing. The piece-parts interact to provide dual-environment, out-of-sequence safety and arming functions. Complexity comes from the need for pins, screws, bushings, specialty springs, lubrication, dissimilar materials, and assembly, as well as the necessity to maintain tight tolerances on all parts for trouble-free operation.

In summary, there is a need in the prior art for the development of an ultra-miniature, monolithic, mechanical S&A device for projected munitions, and more particularly there is a need to design and manufacture fuze mechanical S&A devices which are significantly smaller, thereby providing more space in the munitions for payload or electronics. In addition, there is a need for the development of a fuze S&A fabrication technique that can replace or reduce dependence on a dwindling, and even disappearing, domestic precision small-parts manufacturing base. Furthermore, there is a need for the development of a theory, approach and design for a flexible fuze S&A fabrication technique that enables fuze developers/manufacturers to make changes to a fuze S&A design involving relatively simple exposure-mask and process-parameter changes to the LIGA-MEMS (or other micromachining) process, compared to the large cost and delay of retooling a factory line to achieve the same goal.

In the latter regard, there is a need for improvement in the ease with which mechanical S&A devices interface and integrate with increasingly electronics-intensive fuze architectures. Moreover, there is a need for the development of improvements in potential shelf-life of mechanical S&A devices, taking advantage of the fact that microscale moving parts do not require lubrication to function. Finally, there is a need for an increase in safety and reliability in fuzing and safety devices by taking advantage of the ease with which redundant functions may be built and tested in high-rate micromachining production processes.

The following additional U.S. patents are considered to be representative of the prior art relative to the invention, and are burdened by the disadvantages set forth herein: U.S. Pat. Nos. 2,475,730; 2,710,578; 4,195,575; 4,770,096; 4,793,257; and 4,891,255.

SUMMARY OF THE INVENTION

The invention generally relates to an ultra-miniature, monolithic, mechanical S&A device for projecting munitions. The invention accomplishes the functions of a mechanical S&A device for projected munitions, but does so in a smaller package, using a new and growing industrial base (MEMS) with characteristics of the technique and technology to make the invention architecture able to be tailored and flexible to meet the needs of whole "families" of munitions. The functions of the device, therefore, are such as to provide a dual-environment S&A for munitions fuzing. Physical inputs corresponding to proper arming sequences result in a minimum of two independent mechanical locks being removed from an arming slider so that the slider is free to remove a barrier in the explosive train or to move out-of-line elements of the explosive train into line in order to arm the fuze or to mechanically close switches that enable the fire circuit to operate. The mechanical locks or "detents" respond only to specific physical inputs corresponding to valid launch or deployment conditions, and must be operated in a specific order in order to unlock the arming slider. Physical inputs received in an incorrect order will not result in arming of the fuze, and instead will result in a fail-safe condition. With respect to the latter information, a "detent" is defined as "a device, such as a catch or a spring-operated ball, for positioning and holding one mechanical part in relation to another so that the device can be released by force applied to one of its parts" (Webster's Ninth New Collegiate Dictionary, 1985). Thus, the term "detent" is used herein to denote a class of environmentally-driven mechanical catches or locks which are used to secure actuating sliders and rotors in a mechanical S&A device. The term "detent" is also sometimes used in the literature as synonymous with "safety-lock".

In view of the objective that the S&A device of the present invention be based on MEMS technology, a LIGA-MEMS S&A module design has been conceived so as to incorporate the dual-safety-environment, multiple-mechanical-interlock approach used in many fielded mechanical S&A devices, although the inventive design generally results in the reduction of the mechanical S&A to a one-chip module. More specifically, an objective of the present invention is to incorporate the "heart" of the S&A module onto a single chip; however, the invention should not be construed as being restricted to the employment of other chips, such as a top (cover) chip, a bottom chip, or both, since such additional chips may contribute features that interact with the "S&A chip". Thus, the invention does not preclude the employment of chips to provide certain complementary functions, such as to carry or position an explosive charge or a slapper detonator or a semiconductor bridge, provide electrical contacts, provide capacitive pick-up or an induction coil, etc.

In addition, the S&A module was expressly developed for high-speed artillery applications because, with large launch accelerations to work with (e.g., launch accelerations in the range of 10,000 to 80,000 G's-peak), the inertially actuated elements in the module could be subjected to the greatest miniaturization. The module design is adaptable, however, to the full range of projected munition launch accelerations, including mortars. It is expected that the design of the present invention will have the advantage of being easily and flexibly incorporated into the overall electrical and mechanical design of fuzes for both large and small artillery.

The mechanical S&A device of the present invention physically records the launching of the munitions, and then physically alms the firing circuit by moving active fire-train elements (which, for safety, were held out of line) to an in-line position. When battery power comes up, the electronic side of the system then detects the status of the mechanical elements, and continues the arming sequence. With respect to safety, the S&A module performs the role of not allowing arming to occur as a result of logistical inputs, such as transportation vibration or mishandling drops.

Therefore, it is a primary object of the present invention to develop an ultra-miniature, monolithic, mechanical S&A device for projected munitions.

It is an additional object of the present invention to provide an S&A device that is significantly smaller than prior, similar devices.

It is an additional object of the present invention to provide an S&A device that is developed as a result of implementation of a micromachining (MEMS) fabrication technique.

It is an additional object of the present invention to provide an S&A device architecture that permits changes to be made to the design with relatively little effort because they involve only simple exposure-mask and process-parameter changes to the microelectromechanical system or other micromachining process.

It is an additional object of the present invention to provide an S&A device that readily interfaces and integrates with increasingly electronics-intensive fuze architectures.

It is an additional object of the present invention to provide an S&A device that has increased safety and reliability by the incorporation of redundant functions into the device.

It is an additional object of the present invention to provide an S&A device that will only be properly armed as a result of a minimum of two independent mechanical locks being removed from an arming slider so that the slider is free to remove a barrier in the explosive train or to move out-of-line elements of the explosive train into line to arm the fuze.

It is an additional object of the present invention to provide an S&A device in which mechanical locks or detents respond only to specific physical inputs corresponding to valid launch or deployment conditions.

The above and other objects, and the nature of the invention, will be more clearly understood by reference to the following detailed description, the associated drawings, and the appended claims.

DETAILED DESCRIPTION OF THE INVENTION

Figure 1:
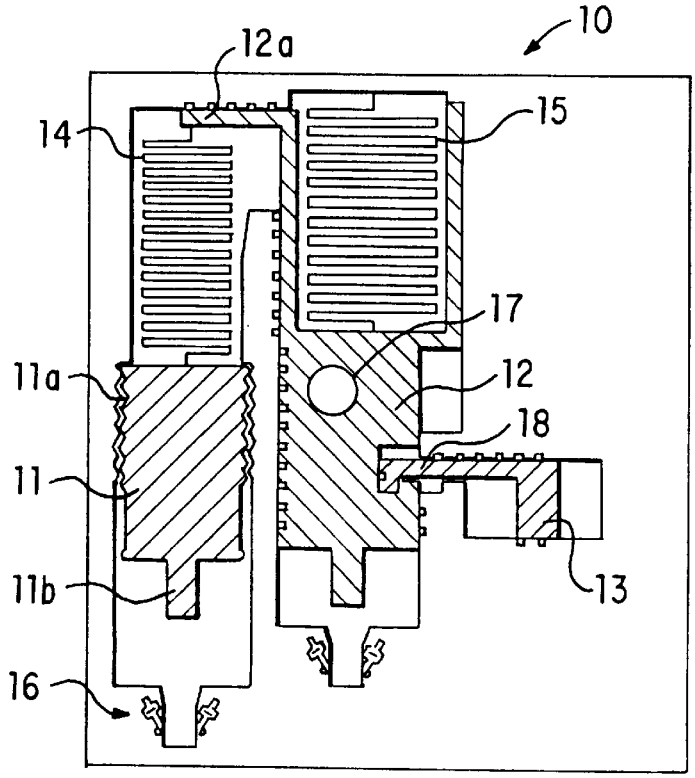
FIG. 1 is a diagrammatic representation of a first embodiment of the ultra-miniature S&A device of the present invention.

FIG. 1 is a diagrammatic representation of a first embodiment of the ultra-miniature S&A device 10 of the present invention. As seen therein, the first embodiment of the invention comprises the following components: sliders 11–13; reset springs 14 and 15 associated with sliders 11 and 12, respectively; slider latch 16 associated with slider 11; squib initiator 17; and out-of-sequence interlock 18.

In general, the first embodiment employs an interlocking trio of sliders 11–13 which operate sequentially in the launch environment to arm the fuze S&A. Slider 11 is a delay slider, slider 12 is an arming slider, and slider 13 is a safety interlock slider. The sliders 11 and 12 and their springs 14 and 15, respectively, and slider 13, are released from the substrate during the LIGA process. In particular, sliders 11 and 12 are controlled by reset springs 14 and 15, respectively, while slider 13 provides a safety interlock feature via the out-of-sequence interlock 18. The interlock 18 is removed by a gas generator (not shown) upon command. The successful operation of the module during launch causes the slider 12 to remove a barrier that is interrupting the fire train, and also to bring sensitive elements into line with the rest of the fire train.

Figure 2:
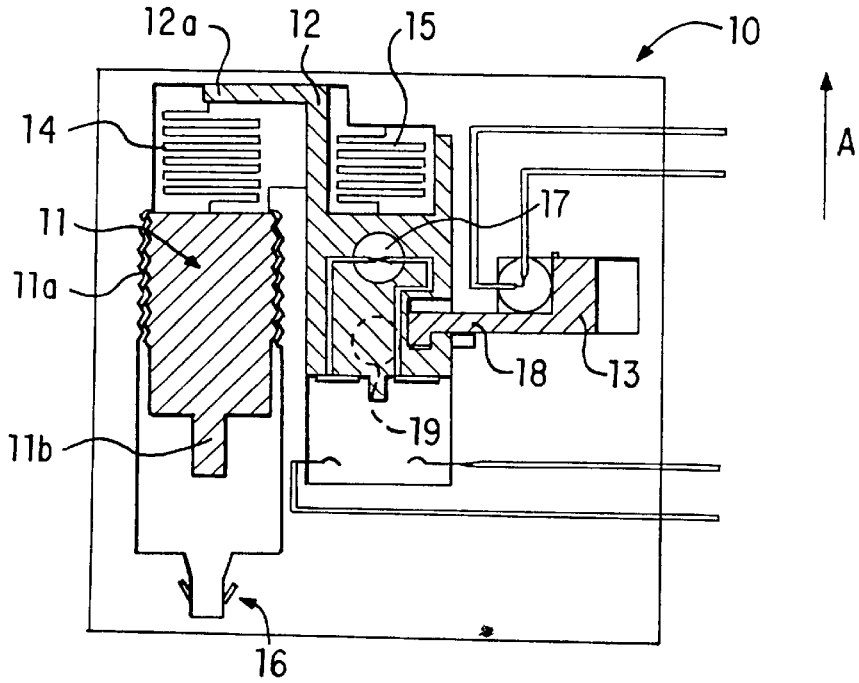
FIG. 2 is a diagrammatic representation of the device of FIG. 1 in the safe position.

Operation of the invention will now be described with reference to FIGS. 2–7. In that regard, FIG. 2 is a diagrammatic representation of the device of FIG. 1 in the safe position, and thus the unarmed state of the elements of the invention is shown in FIG. 2. Specifically, in FIG. 2, the reset springs 14 and 15 are shown in their as-fabricated state, while the sliders 11–13 are shown in their starting positions. The design of the invention assumes that the arming acceleration is going to be in the upward direction in the figures, as indicated by the arrow A in FIG. 2.

In operation, the safing action of the invention comes into play when acceleration pulses are received by the module prior to launch, e.g., during handling and loading operations in the logistical train. Slider 11 is designed so that such acceleration pulses will cause it to move downward by only a small amount along its zig-zag track 11*a*, thereby avoiding unintentional aiming of the device. Once the acceleration pulsing is completed, the slider 11 is brought back to its home position by reset spring 14. Preferably, the design of the invention tolerates acceleration impulses producing a velocity change of up to 51 feet per second (corresponding to a 40-foot handling drop safety requirement) without aiming.

Figure 3:
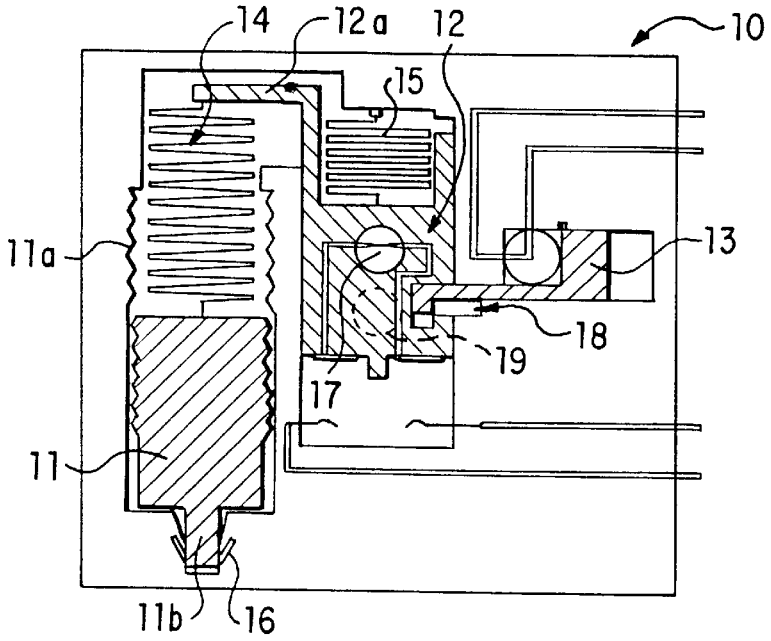
FIG. 3 is a diagrammatic representation of the device of FIG. 1 when partially armed.

When the acceleration pulses are greater than the tolerance level just stated, such as during launch, slider 11 has time to bump its way down the track 11*a* to the bottom thereof. This "bumping operation" results from interaction between the zig-zag contour of the track 11*a* and the corresponding zig-zag contour of the upper portion of the slider 11. When the slider 11 reaches the bottom point in its movement, it jams its ratcheted foot 11*b* into the latch mechanism 16. This position of the slider 11 is depicted in FIG. 3, which is a diagrammatic representation of the device of FIG. 1 when partially aimed. Referring to FIGS. 2 and 3, it should be noted that the last portion of the travel of slider 11 is, preferably, "free fall" in nature so that the slider 11 gains momentum for the purpose of forcibly entering the latch mechanism 16.

Further referring to FIG. 3, once slider 11 latches itself in mechanism 16 at the bottom of its path of travel, reset spring 14 pulls down on the arm 12*a* of slider 12. At this point, slider 12 would be drawn downward into the armed position except that slider 13 prevents it from doing so. However, the tension from slider 11 does move slider 12 in the downward direction by a sufficient distance to clear the out-of-sequence interlock mechanism (or catch) 18 located on slider 13.

The out-of-sequence feature of the present invention is an important and unique characteristic of the design of the invention. Upon command, slider 13 normally is propelled to the side (in the rightward direction in FIG. 3) by an actuating force provided by an actuator. By way of example, the actuator can be implemented by a gas generator, by an on-board micro-scale MEMS actuator (e.g., a MEMS thermal actuator), by inertial means (e.g., spin centrifugal acceleration), or other appropriate means including, but not limited to, acceleration, pressure, temperature, magnetic force or electrical action. In summary, the particular actuation technique or method can be selected from a diverse collection of actuation techniques or methods without departing from the spirit and scope of the invention.

The actuator is fired by a command from fuze control logic (also not shown) once the second launch environment, presently unspecified, is detected. If the gas generator fires out of sequence (that is, before slider 11 has latched in the downward position and urged slider 12 downward against slider 13), then the engagement between sliders 12 and 13 prevents slider 13 from moving out of the way. As a result, the module has achieved a "fail safe" capability. Slider 12 cannot thereafter be brought into the armed position.

However, if the gas generator fires in the correct sequence (some time after slider 11 has latched downward into latch mechanism 16), slider 13 is moved to the right and out of the "interlock" posture, and the tension from spring 14 draws slider 12 downward into the aimed position. This stage of the operation of the invention is shown in FIG. 4, which is a diagrammatic representation of the device of FIG. 1 when fully aimed.

Figure 4:
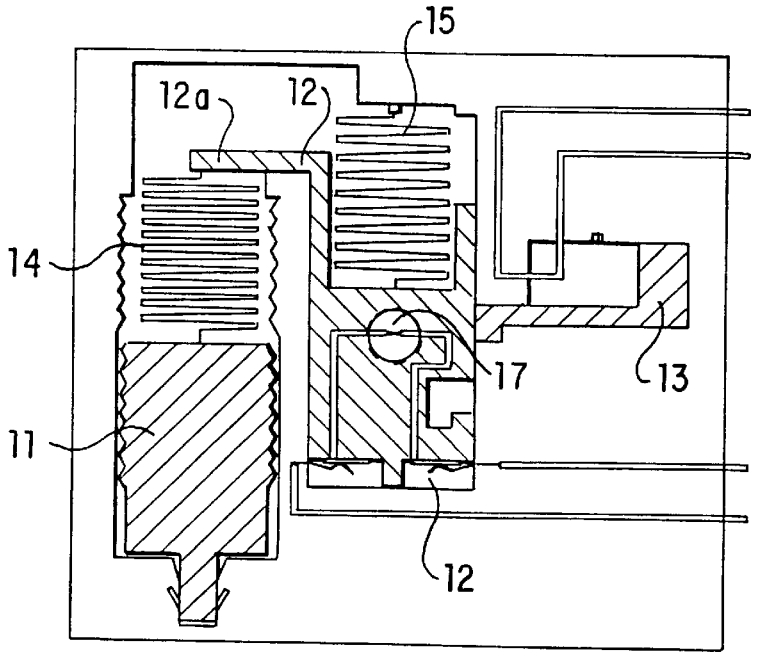
FIG. 4 is a diagrammatic representation of the device of FIG. 1 when fully armed.

Referring to FIG. 4, the spring 14 associated with slider 11 is, preferably, much stiffer than the spring 15 associated with slider 12. When slider 12 is in the armed position, two simultaneous results are obtained. First, the motion of slider 12 mechanically closes a switch (not shown) which enables the fuze arming circuit to function. Second, the motion of slider 12 brings the out-of-line explosive train element or squib initiator 17 of slider 12 in line with the remainder of the fire circuit or fire train outside the module. Thus, the squib initiator 17 and fire-train (not shown) are aligned and, at this point, the invention is fully armed.

In designing the reset springs 14 and 15 discussed above, an ANSYS finite element model was used to determine the spring rate and stress levels in the convoluted spring designs. The spring design involved several tradeoffs. The spring had to be able to extend to approximately twice its original length without yielding the material. The spring rate had to be sufficient to reset the mass after small impacts, but without impeding its movement during actual launch. In addition, the spring had to fit in a limited space, while meeting all of the LIGA-MEMS design rules. The design rule limiting the run of an unsupported thin member to less than 1/10th its width leads to a convoluted shape of the spring.

Figure 5A:
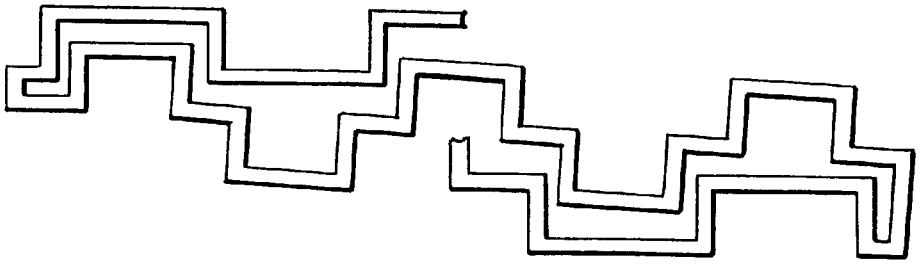
FIG. 5A is a diagrammatic representation of a single coil of a deflected reset spring for the arming slider of the first embodiment of the invention.
Figure 5B:
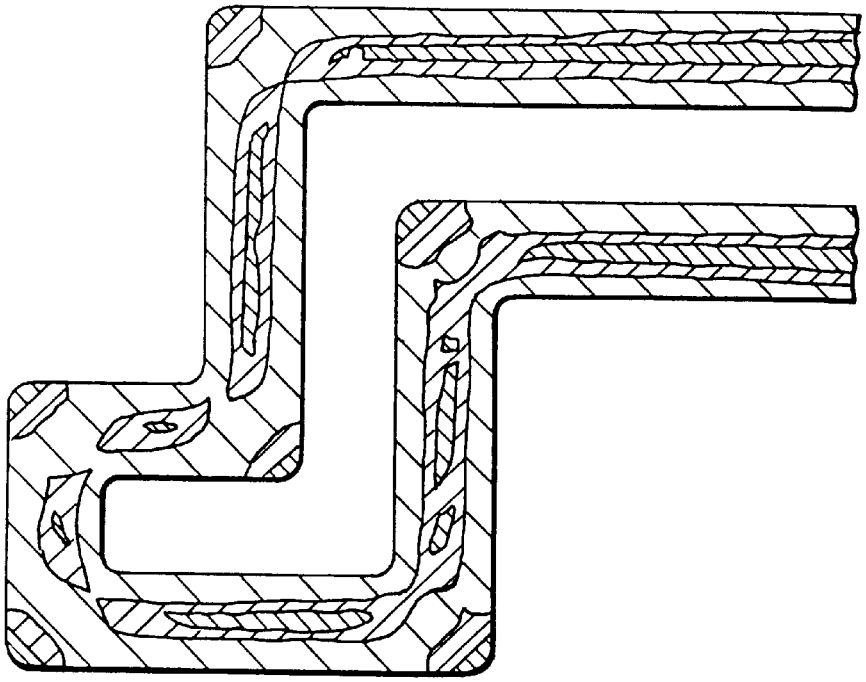
FIG. 5B is a diagrammatic representation of a close-up stress profile of the reset spring for the delay slider of the first embodiment of the invention.

FIGS. 5A and 5B depict a single coil of the reset spring 14 and a close-up of the stress profile of reset spring 14, respectively. At full extension, the spring just reaches the material yield stress based on figures published in engineering handbooks for nickel.

Computer models were developed and utilized to predict the performance of slider 11. The developed programs accommodate a variety of design assumptions and acceleration inputs. Traditional mechanical S&A's have often used zig-zag devices with a linear stroke of approximately 0.25 inches. Adequate delay action could be obtained with only a few reversals of motion (zigs and zags) because of the large stroke. However, in the miniature world of MEMS, the stroke has to be much smaller, and thus the number of motion reversals has to increase. Computer programs permit slider motion to be modeled for a large number of cases involving tradeoffs between rack tooth angle, tooth pitch, amplitude of side-to-side motion, rack length, and so forth. Such programs were used to predict the performance curves in FIGS. 6A, 6B and 7.

Figure 6A:
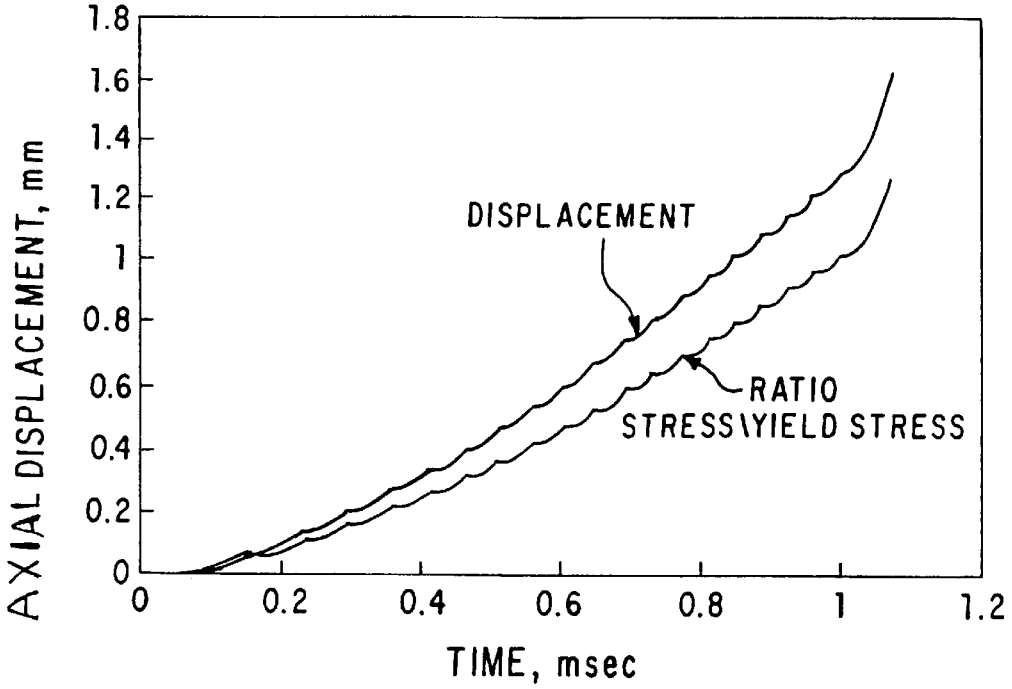
FIG. 6A is a graph of calculated axial displacement versus delay time for the device of the present invention.
Figure 6B:
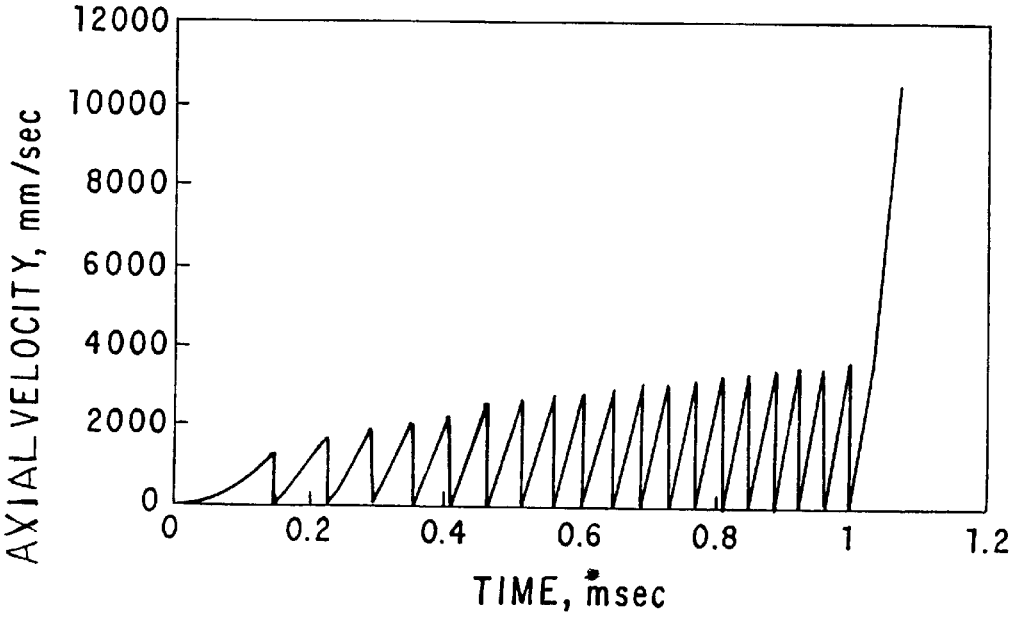
FIG. 6B is a graphical illustration of calculated axial velocity versus delay time for the delay slider of the first embodiment of the present invention.

In the latter regard, FIGS. 6A and 6B depict the predicted performance of the zig-zag delay device (slider 11 of FIGS. 1–4) under a half-sine acceleration pulse of 25,000 G's amplitude and 0.004 seconds duration. This is considered to be the minimum input at which slider 11 is to latch. FIG. 6A shows the axial displacement of the slider 11 as it moves down the track 11*a*, and then goes into free-fall at the end. The stress profile is also given on FIG. 6A as the ratio of spring stress to material yield stress. It indicates that the spring material begins to yield once the slider 11 clears the zig-zag track 11*a*.

FIG. 6B shows the axial velocity of slider 11 during the half-sine input pulse. Each time the teeth of slider 11 slide down one side of the track 11*a* to the other, the slider 11 returns to zero velocity, and is then accelerated again down the opposite face of track 11*a*. The design of the present invention incorporates 20 cycles before the slider 11 clears the track 11*a* and goes into free-fall. The calculated duration from start to latch for slider 11 is just over 1 millisecond.

Figure 7:
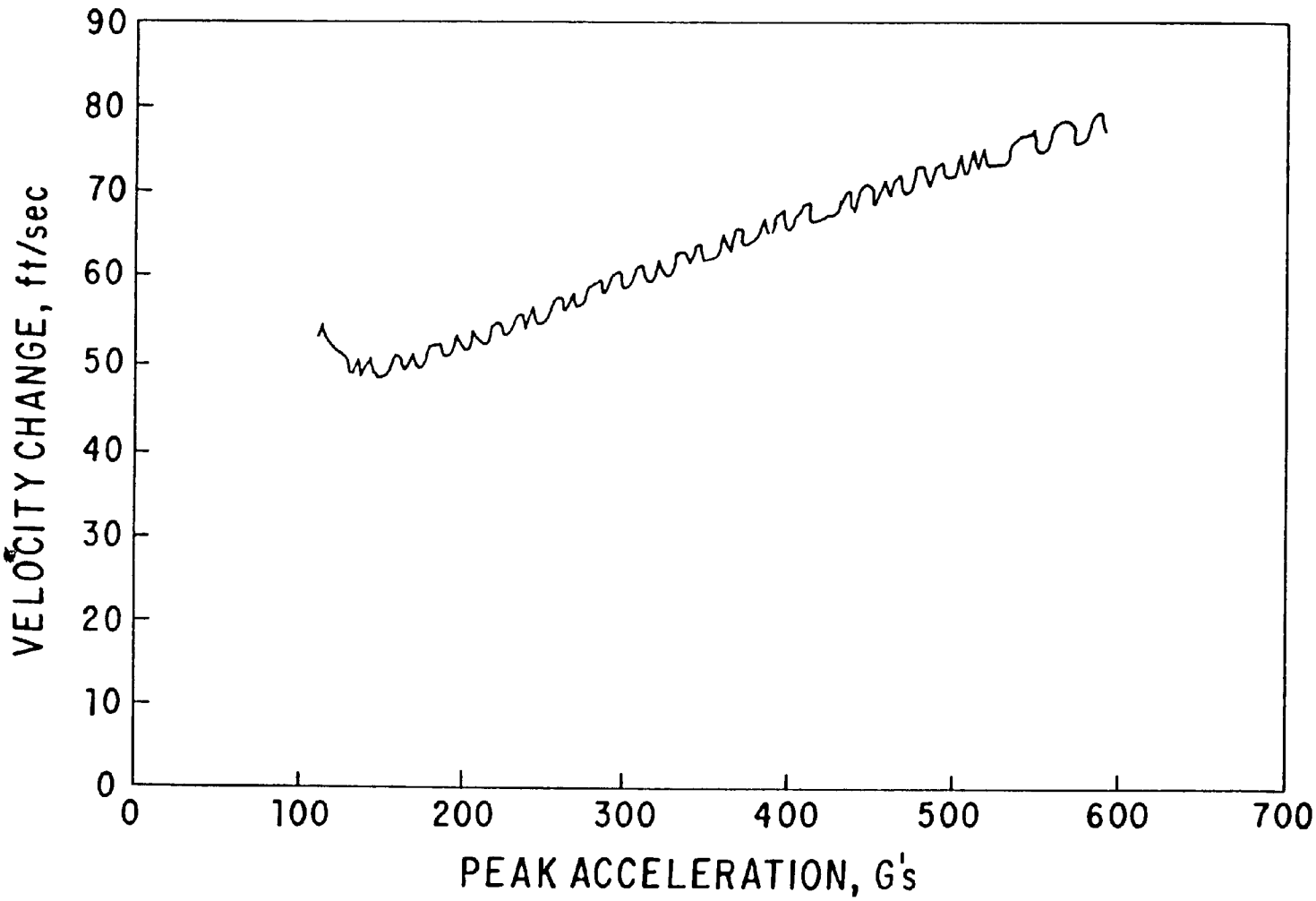
FIG. 7 is graphical illustration of an arming curve for the device of the present invention.

The overall performance of the invention is summarized in the arming curve of FIG. 7. For input conditions below the curve, the slider 11 will remain safe. For input combinations on or above the curve, the slider 11 will arm. Points on the curve are understood as follows: a dropped article will normally see a deceleration impulse shaped like a half sine upon hitting the ground. However, for arming safety, the worst case impulse is a rectangular or square wave pulse, and therefore the curve of FIG. 7 assumes rectangular impulses. This rectangular impulse has a peak acceleration value, which is the G-level, and duration. For every drop height, there is a corresponding impact velocity on the Y-axis which equals the change in velocity needed to bring the article to rest. The curve shows that the least safety occurs for a 40-foot drop (yielding a velocity of 51 ft/sec) onto a material that yields about 140 G's-peak. Drops onto harder or softer materials will be even safer.

Figure 8:
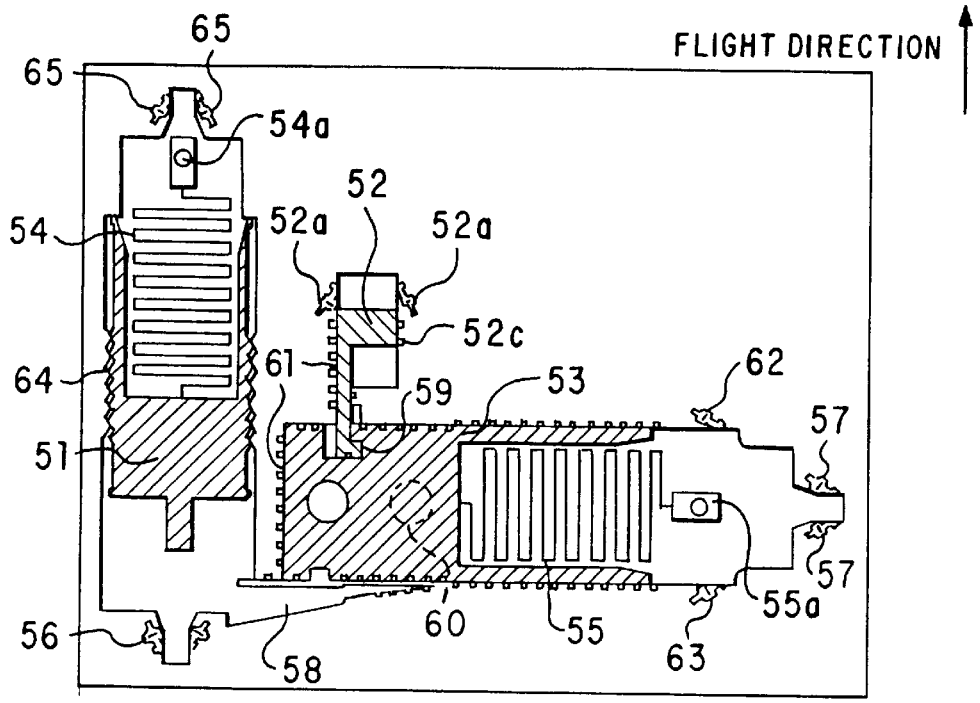
FIG. 8 is a diagrammatic representation of a second embodiment of the S&A device of the present invention.

FIG. 8 is a diagrammatic representation of a second embodiment of the S&A device of the present invention. As seen therein, the embodiment of FIG. 8 comprises the following components: sliders 51–53; springs 54 and 55 associated with sliders 51 and 53, respectively; latch 56 associated with slider 51; latch 52*a* and shear tab 52*c* associated with slider 52; safety lock 58; out-of-sequence lock 59; initiator 60 located in or below slider 53; spring biasing head 55*a* associated with spring 55 and latch 57; latch mechanism 62, 63 associated with slider 53; and zig-zag track 64 associated with slider 51.

It should be noted that the small rectangular indentations 61 associated with slider 52 and around slider 53 serve as "fenceposts" to support the thin "fence" in the negative image block of the LIGA process, over which the positive image is molded, so that the "fence" in fact becomes the vertical (out of the plane of the paper in FIG. 8) gap between the "land" and the defined slider. Hence, the rectangular indentations 61 are an artifact of adapting the design to the LIGA fabrication technique. These artifact shapes may not be necessary if another form of microfabrication technique is used.

In general, the second embodiment shown in FIG. 8 is an advanced S&A design incorporating advanced concepts, such as spring biasing, die stacking, porting of gas generator outputs, bridgewire initiation, and increased safety due to improved sequencing of events. The advanced design also employs an interlocking trio of sliders 51 53 operating sequentially in the launch environment to arm the fuze S&A. Slider 51 is a delay slider, slider 52 is a command slider, and slider 53 is an arming slider. As with the previously described embodiment, the sliders 51–53 and springs 54–55 along with all latches (52*a*, 56, 57, 58, 62, 63 and 65) are released from the substrate during the LIGA process; sliders 51 and 53 are controlled by reset springs 54 and 55, respectively; and slider 52 provides a safety interlock that is removed by the actuator (not shown) upon command.

Figure 9:
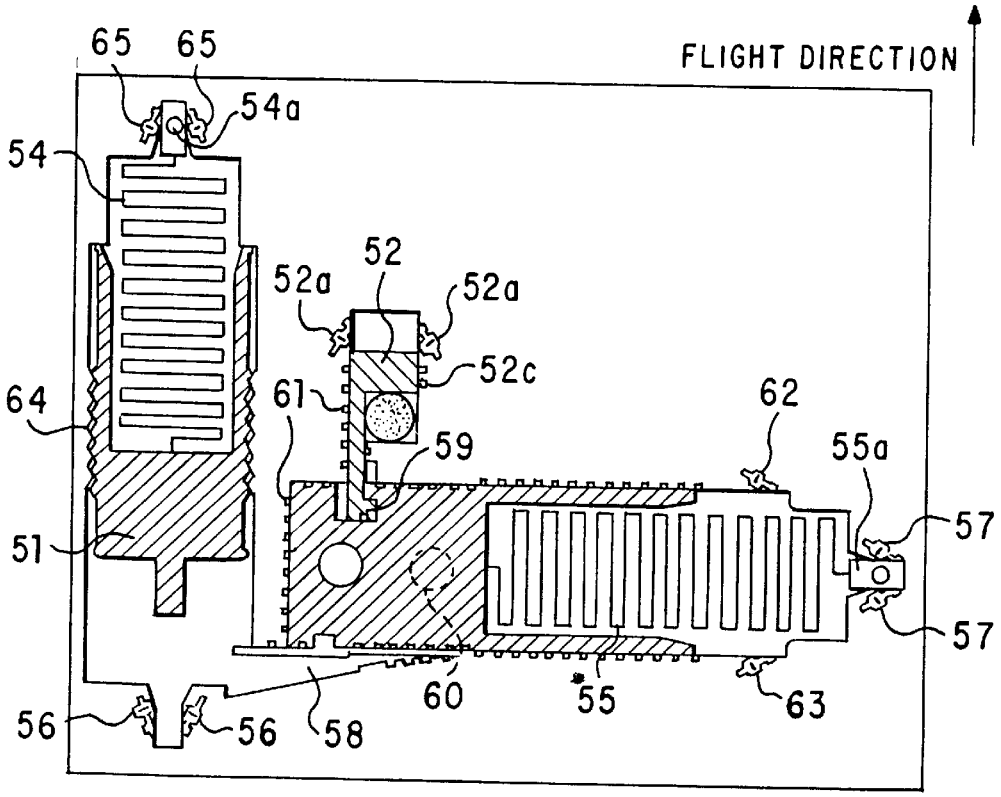
FIG. 9 is a diagrammatic representation of the device of FIG. 8 with spring biases set before packaging or use.

Further referring to FIG. 8, the heads 54*a* and 55*a* of springs 54 and 55, respectively, are left floating or may be fabricated with a breakaway anchor tab, so that, before packaging of the module, a pre-bias force can be introduced into each spring by micro-manipulating the heads 54*a* and 55*a* into the spring bias latches 65 and 57, respectively. Latching of the heads 54*a* and 55*a* in latch mechanisms 65 and 57, respectively, is shown in FIG. 9. Mechanical fuzes, in general, have a pre-bias built into the setback mass reset spring so that small inertial inputs will not perturb the mass.

The operation of the second embodiment of the invention will now be described with reference to FIGS. 8–11.

Upon launch, slider 51 is drawn downward through the inertial-delay zig-zag track 64. If the acceleration impulse is too weak or too short to accomplish latching, slider 51 is promptly drawn back into its starting position by the biased spring 54. If the acceleration pulse is of sufficient amplitude and duration, the slider 51 completes its travel along the zig-zag track 64, goes into a short free-fall, removes the first safety-lock lever 58, and latches lever 58 in the "down" position (best seen in FIG. 10).

Figure 10:
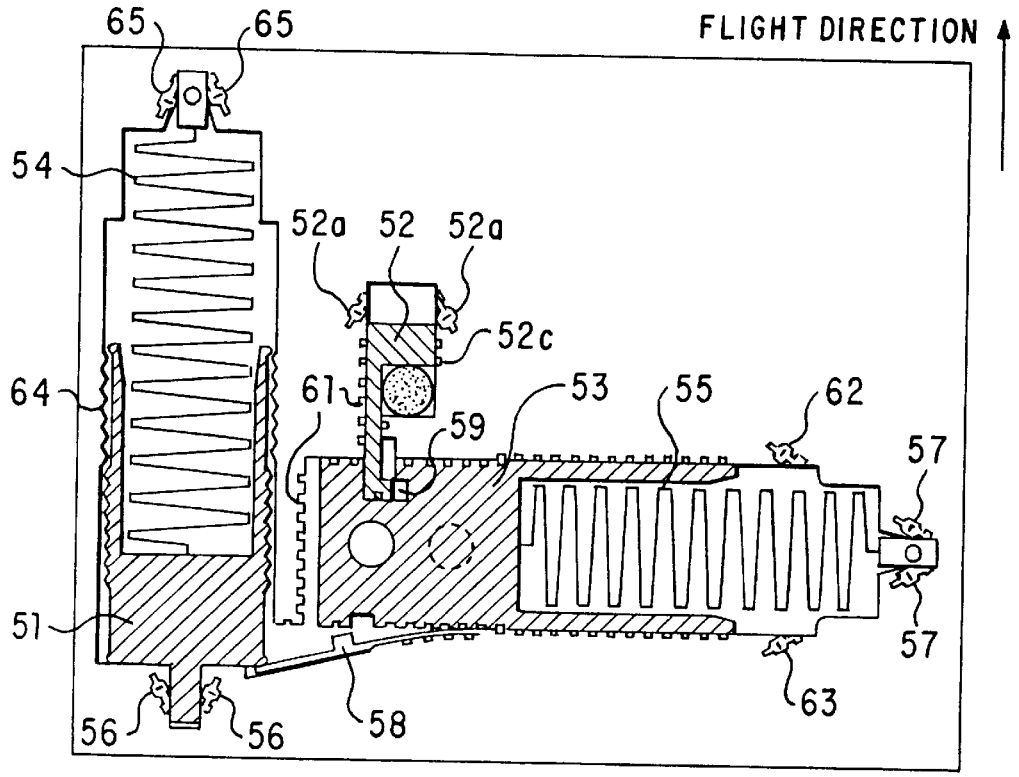
FIG. 10 is a diagrammatic representation of the device of FIG. 8 when partially armed.

Further referring to FIG. 10, removal of the first lock permits slider 53 to move a small amount to the right under the tension of its spring 55, thus clearing the out-of-sequence safety interlock 59 provided by sliders 52 and 53. Thus, the first safety lock must be removed before the second lock is removed.

If the electronic fuze logic (not shown) somehow receives a "second launch environment confirmed" signal while slider 52 is still interlocked with slider 53, the slider 52 actuator (not shown) fires or functions prematurely.

However, because of the interlock, the actuator cannot move slider 52 and does not break the shear tab 52*c*. Thus, the munition will "dud" because slider 53 cannot be moved into the armed position, even if the first safety lock is subsequently removed.

Figure 11:
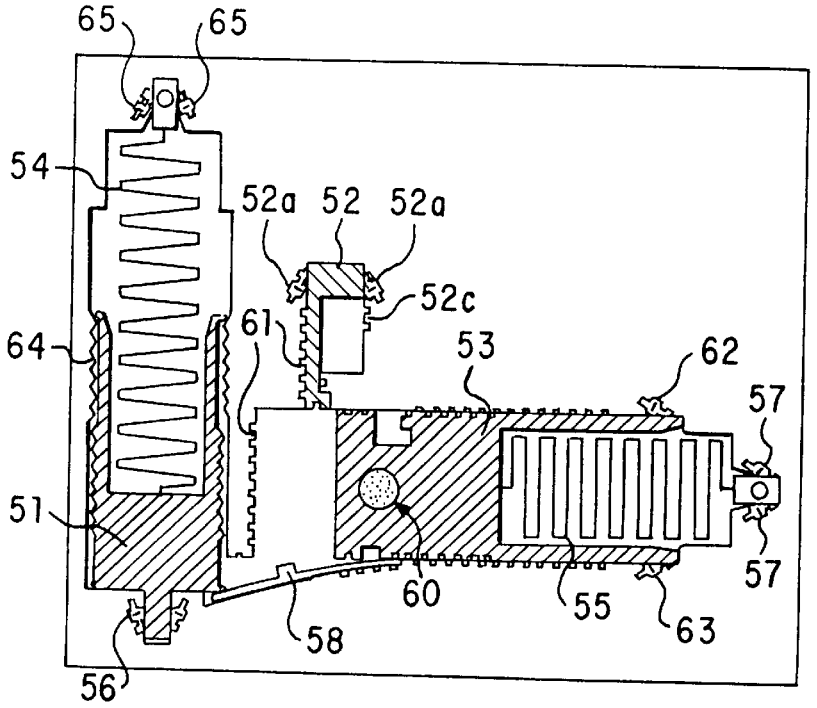
FIG. 11 is a diagrammatic representation of the device of FIG. 8 when fully armed.

Assuming the correct sequence of events, the first safety lock 58 is removed, and the second lock 59 is now ready for a command from the fuze circuit (not shown), indicating that the second safety environment has been detected. FIG. 10 shows this stage of the operation. Upon receipt of the command from the fuze circuit (not shown), the slider 52 actuator (also not shown) functions and creates a force that breaks shear tab 52*c* and moves slider 52 out of the way of slider 53; that is, slider 52 moves upward in FIG. 10. The bias spring force on slider 53 now moves slider 53 to the right (in FIG. 10) and into the "aimed" position. The armed position of slider 53 is shown in FIG. 11.

The motion of slider 53, as just described, has three results. First, when slider 53 latches in latch mechanism 62, 63 at the end of its path of travel to the right in FIG. 11, it closes a switch (not shown), which enables the arming circuit to function. Second, slider 53 was forming a physical barrier between energetic elements that are located below the module and others that are located above the module. This may involve a stacked-die arrangement. Third, the hole 60 in slider 53 contains, preferably, a small element of the fire train, which is now moved into place in the train. If the hole 60 is not used to carry an element of the fire train, it may instead be left open so as to function as the barrel of a slapper detonator, conducting the slapper flyer through the barrel and into the acceptor charge (pyrotechnic) located on the other side of the S&A die. With the energetic elements thus lined up, and the enabling circuit closed, the fuze is now armed.

Figure 12:
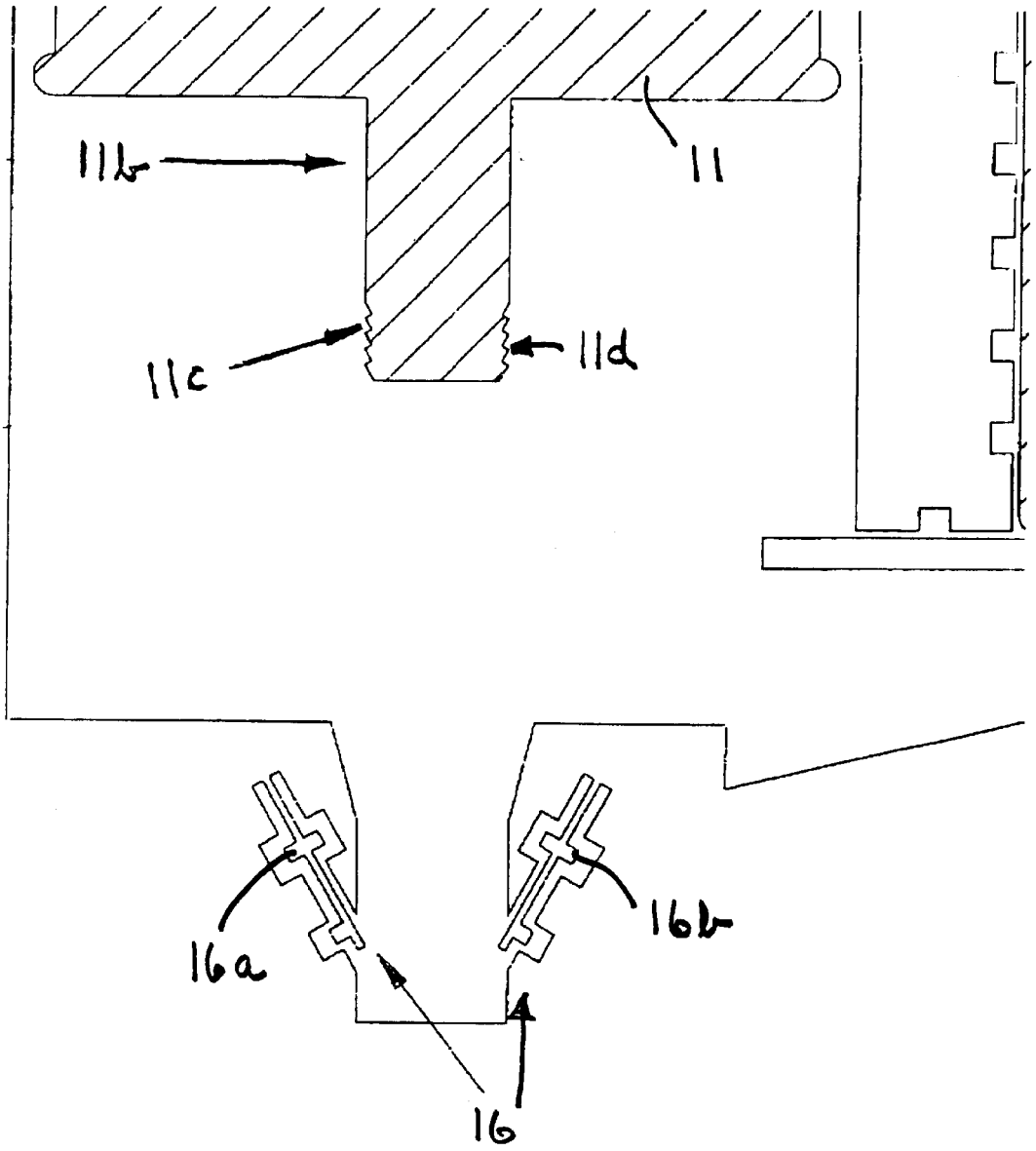
FIG. 12 is a more detailed diagrammatic representation of a portion of the delay slider of the first embodiment of FIG. 1 in its non-captured position.

FIG. 12 is a more detailed diagrammatic representation of a portion of the delay slider of the first embodiment of FIG. 1 in its non-captured position. As seen in FIG. 12, the slider foot 11*b* of delay slider 11 is provided with barbs 11*c* and 11*d* at its distal end. Furthermore, the latch mechanism 16 comprises latch fingers 16*a* and 16*b* which protrude slightly into the space to be occupied by slider foot 11*b*.

Figure 13:
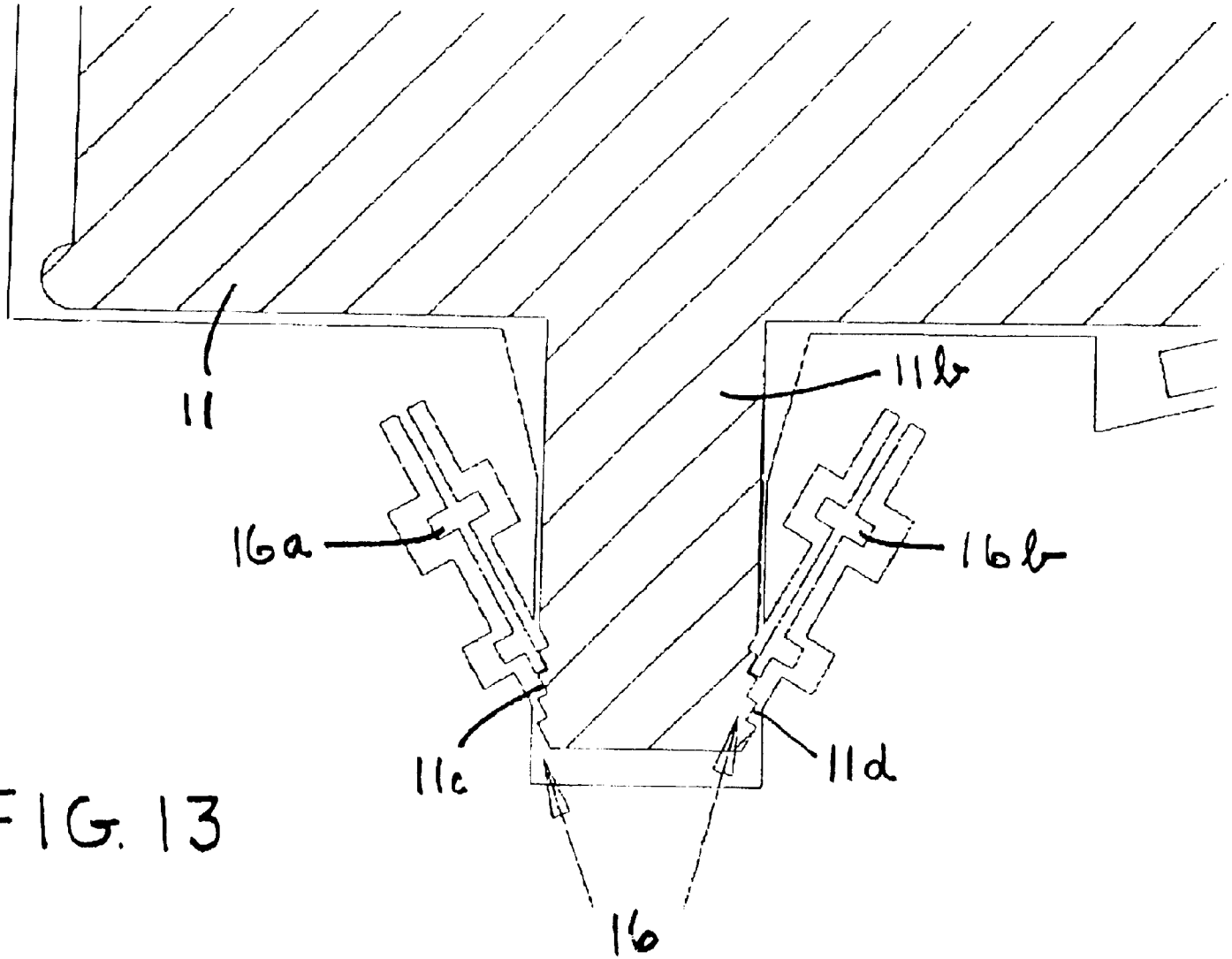
FIG. 13 is a diagrammatic representation of the delay slider of FIG. 12 in its captured position.

Thus, when the slider 11 moves downward and slider foot 11*b* occupies the space between latch fingers 16*a* and 16*b*, fingers 16*a* and 16*b* engage the barbs 11*c* and 11*d*, respectively, on the distal end of foot 11*b*, thereby latching the delay slider 11 in place. This latched position of the delay slider 11 is shown in FIG. 13.

Figure 14:
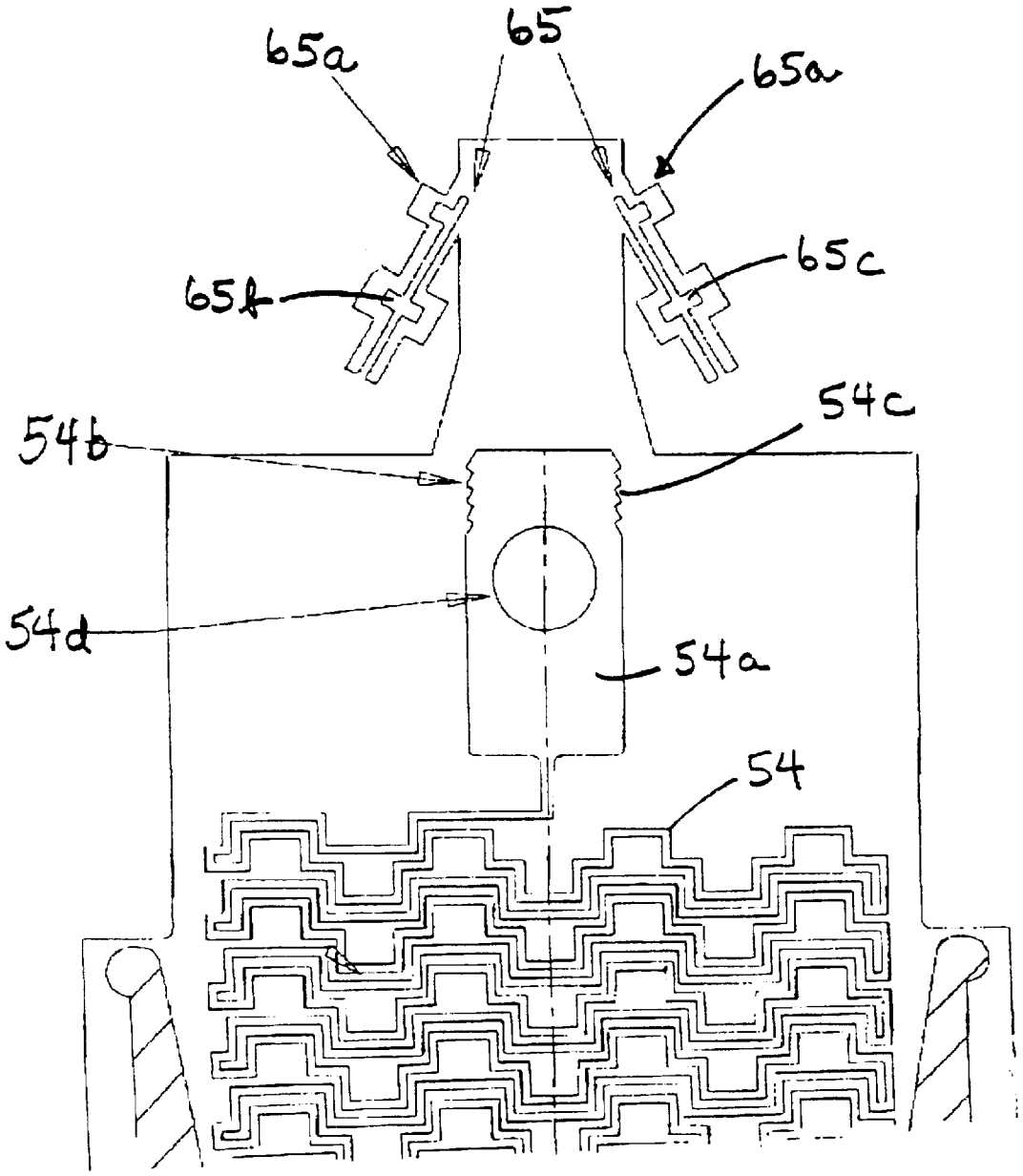
FIG. 14 is a more detailed diagrammatic representation of the delay slider of the second embodiment of FIG. 8 in its equilibrium or unbiased position.

FIG. 14 is a more detailed diagrammatic representation of the delay slider of the second embodiment of FIG. 8 in its equilibrium or unbiased position. As mentioned previously with reference to FIG. 8, prior to packaging of the module, a pre-biased force can be introduced into each spring by micro-manipulating the spring heads, such as head 54*a*, into a spring bias latch, such as latch 65. For this purpose, as seen in FIG. 14, spring bias head 54*a* is provided with barbs 54*b* and 54*c* on its distal end, and is also provided with a hole 54*d* into which a pin (not shown) can be inserted in order to manipulate the head 54*a* and impose a pre-bias force.

Figure 16:
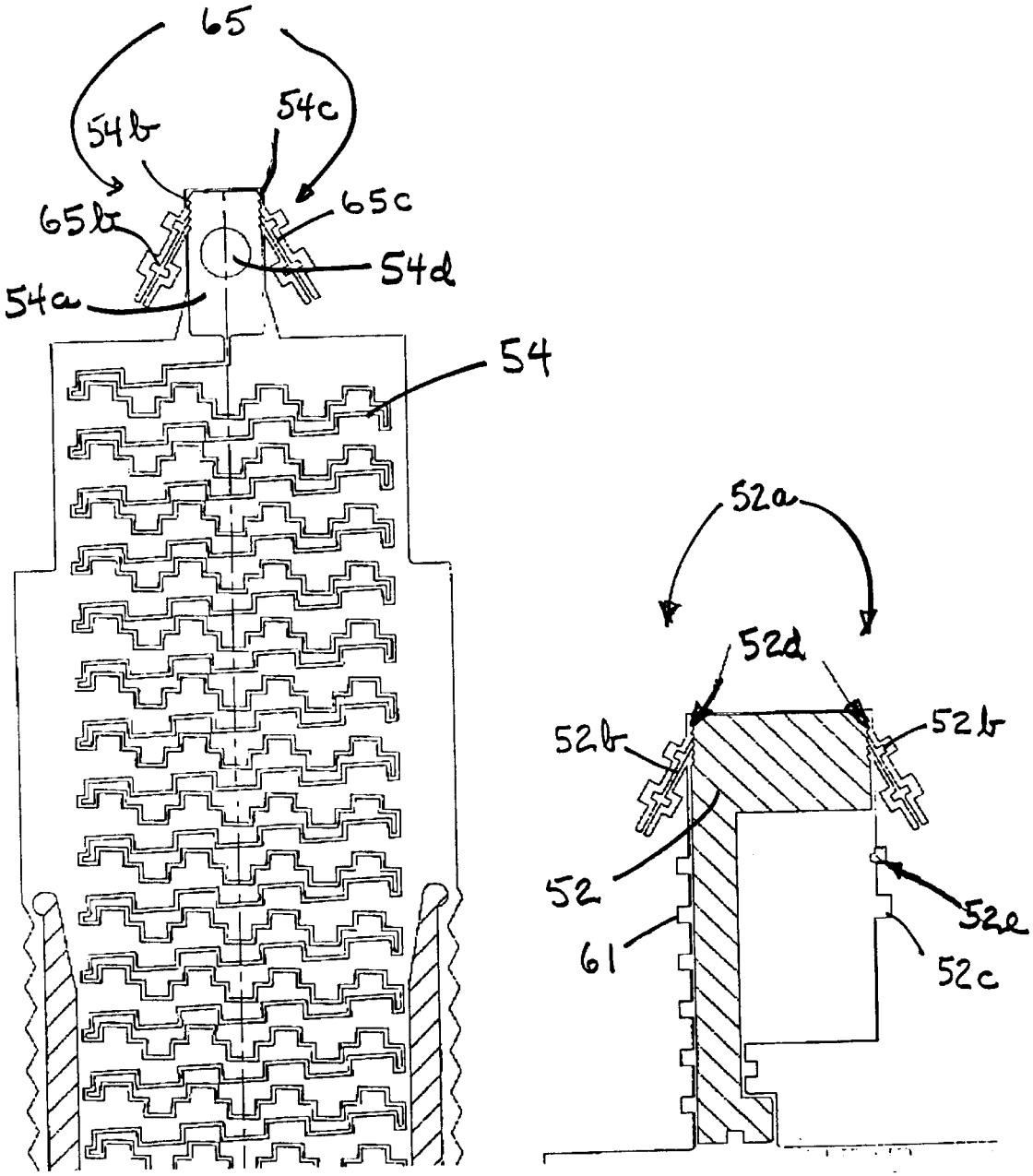
FIG. 16 is a diagrammatic representation of the delay slider and command slider of FIGS. 14 and 15, respectively, with the delay slider in its biased position and the command slider in its fully retracted position.

Thus, upon manipulation of the spring bias head 54*a* in FIG. 14, the head 54*a* is moved upward into the latch 65, wherein the latch fingers 65*b* and 65*c* engage the barbs 54*b* and 54*c*, respectively, thereby locking the spring 54 into a biased state or position. This biased position of spring 54 is depicted in FIG. 16.

Further referring to FIG. 14, it should be noted that the latch mechanism 65 includes artifact features 65*a* which are needed for LIGA fabrication in order to support "fences" in the negative-block mold. It should be noted that the artifact features 65*a* can be dispensed with if desired without departing from the overall scope of the invention.

Figure 19:
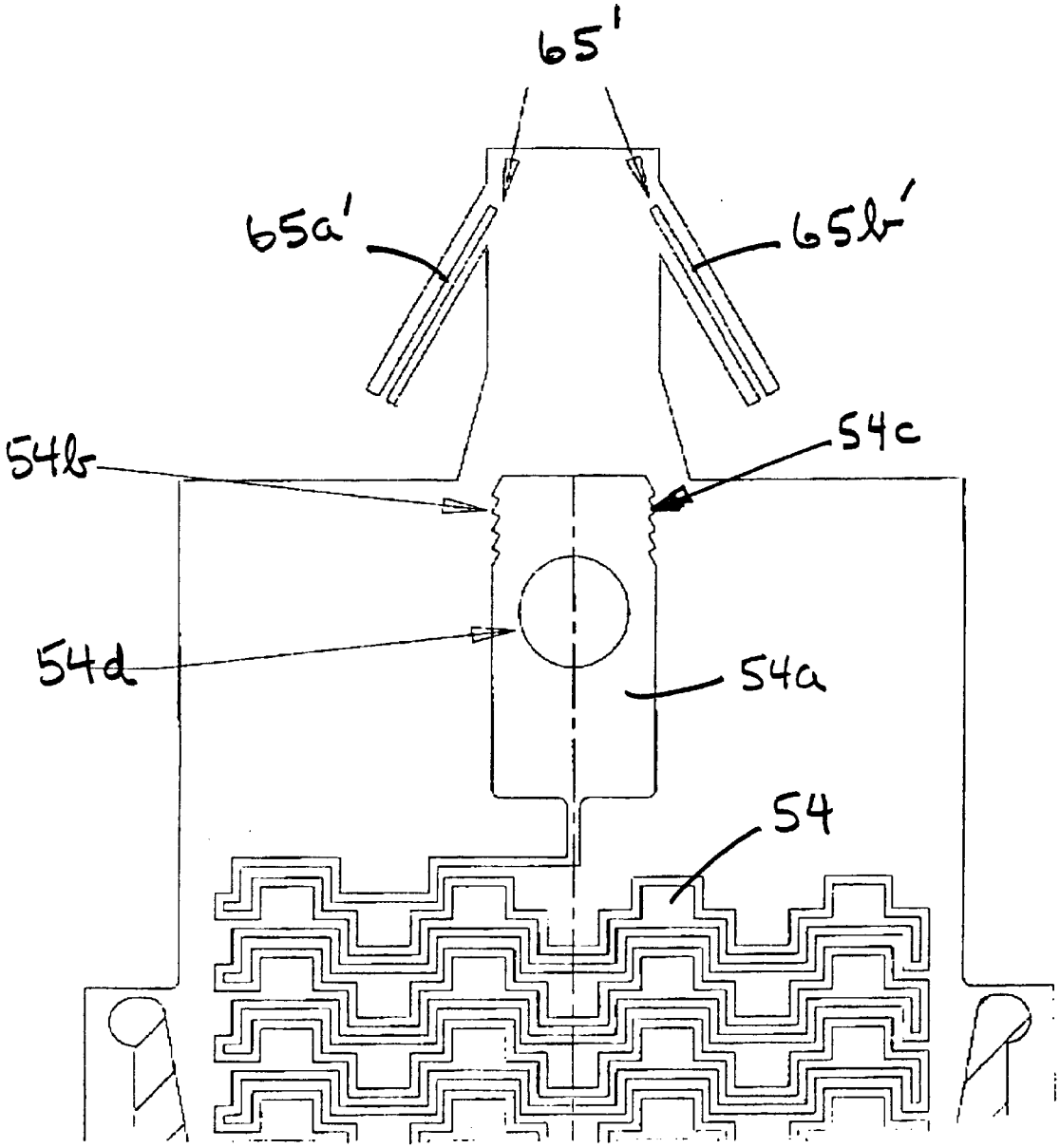
FIG. 19 is a diagrammatic representation of a modified version of the delay slider of FIG. 14.

FIG. 19 is a diagrammatic representation of a modified version of the delay slider bias spring and latch of FIG. 14. As seen therein, the latch fingers 65*a*′ and 65*b*′ do not have the protrusions (i.e., artifacts) which characterize latch fingers 65*b* and 65*c* of FIG. 14. Furthermore, the artifact features 65*a* depicted in FIG. 14 have been dispensed with in the modified arrangement of FIG. 19.

Figure 15:
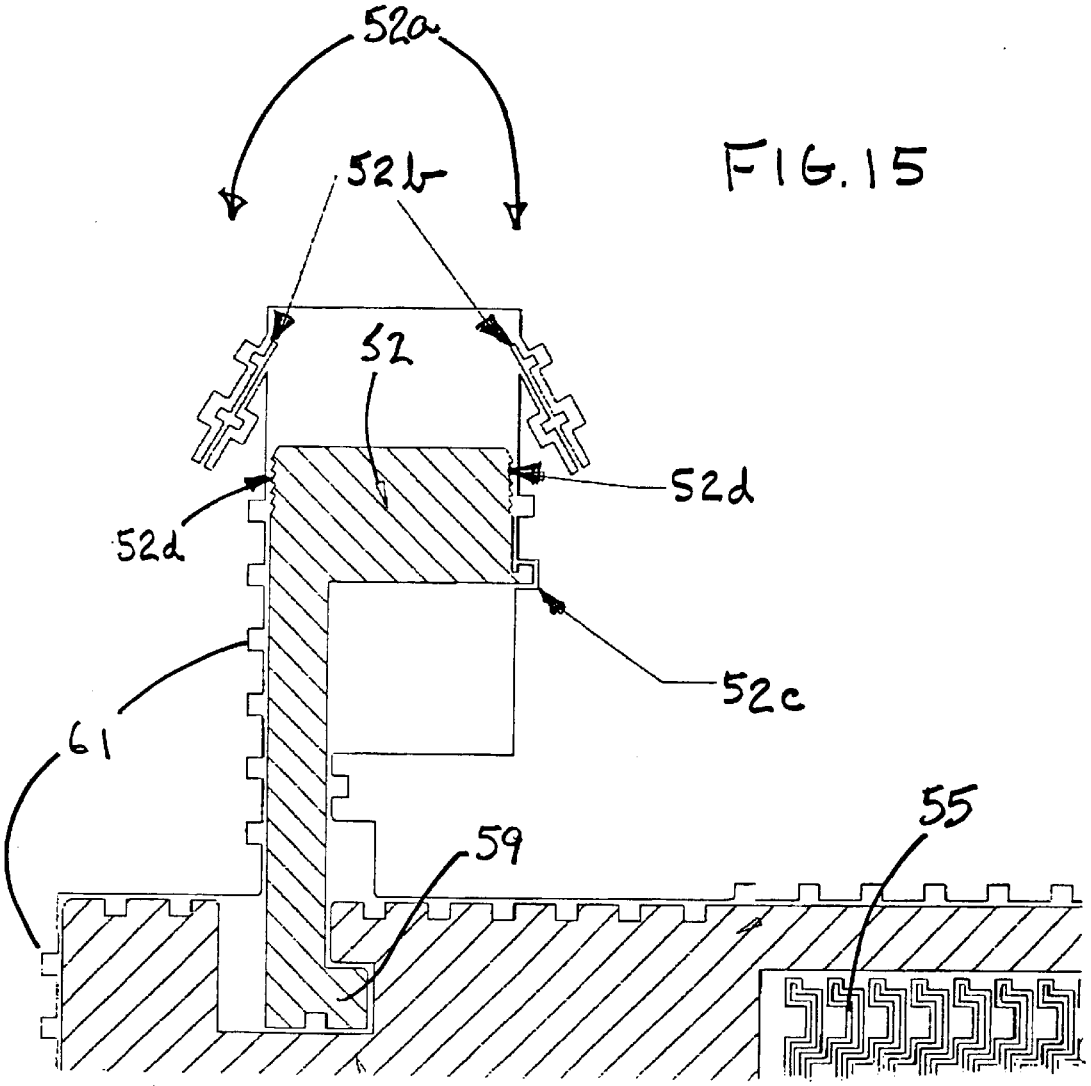
FIG. 15 is a more detailed diagrammatic representation of the command slider of the second embodiment of FIG. 8 in its equilibrium or unbiased position.

FIG. 15 is a more detailed diagrammatic representation of the command slider of the second embodiment of FIG. 8 in its equilibrium or unbiased position. As seen in FIG. 15, command slider 52 is provided, at its distal or upper end, with barbs 52*d*. Furthermore, latch mechanism 52*a* is provided with latch fingers 52*b*. When the command slider 52 moves in the upward direction during operation of the present invention, the barbs 52*d* are engaged with the latch fingers 52*b*, thereby locking the command slider 52 in its latched position. This latched position of command slider 52 is depicted in FIG. 16.

Figure 17:
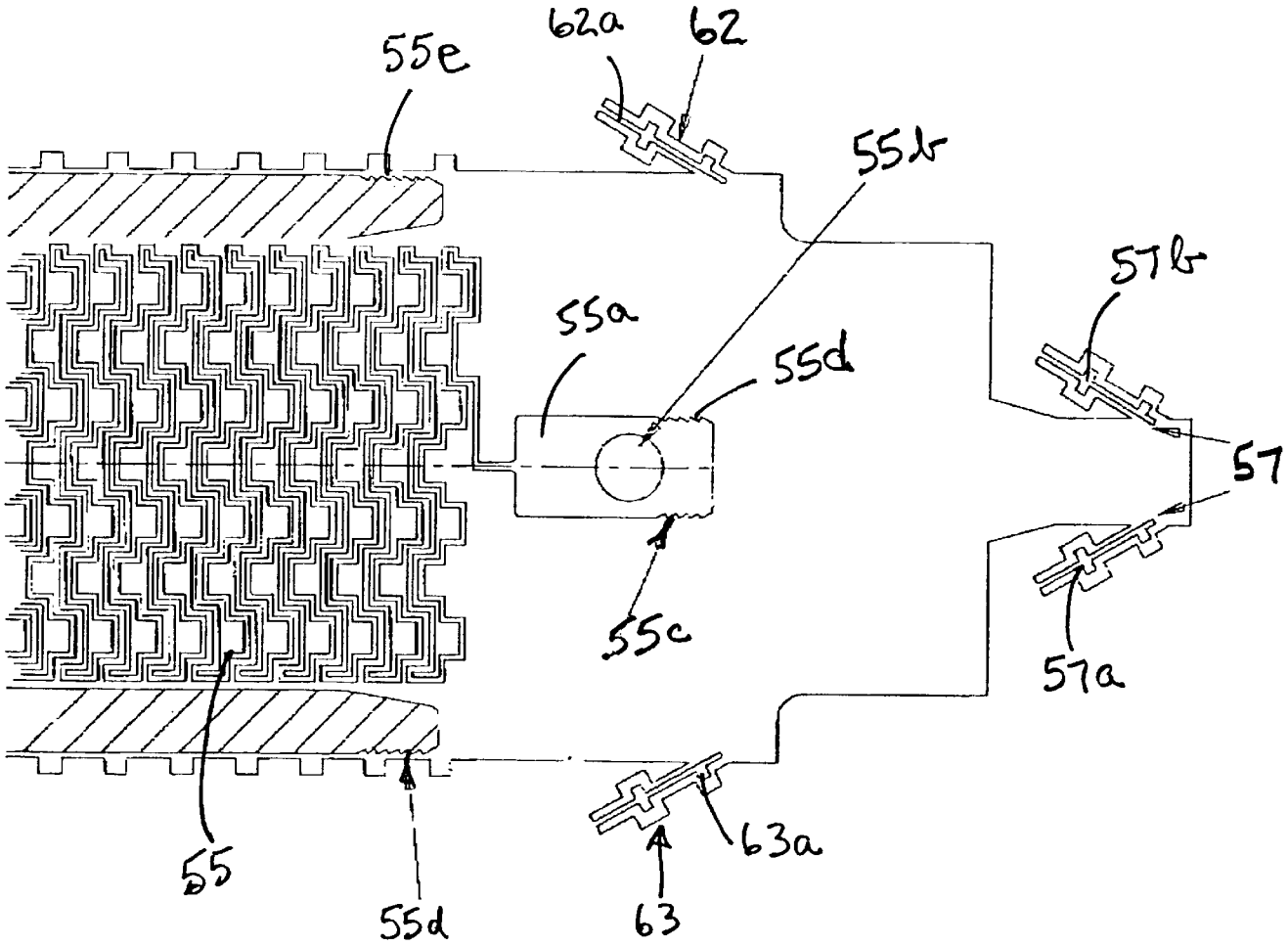
FIG. 17 is a more detailed diagrammatic representation of the arming slider of the second embodiment of FIG. 8 in its unlatched position (with spring unbiased).

FIG. 17 is a more detailed diagrammatic representation of the arming slider of the second embodiment of FIG. 8 in its unlatched position. In a manner similar to the setting of a pre-bias force on delay slider 51 (as described above with respect to FIGS. 14 and 16), a pre-bias force may also be exerted on the arming slider spring 55. Specifically, a pin (not shown) may be inserted into the hole 55*b* contained in the head 55*a* so that the head 55*a* is micro-manipulated into a latched position within the latch mechanism 57.

Figure 18:
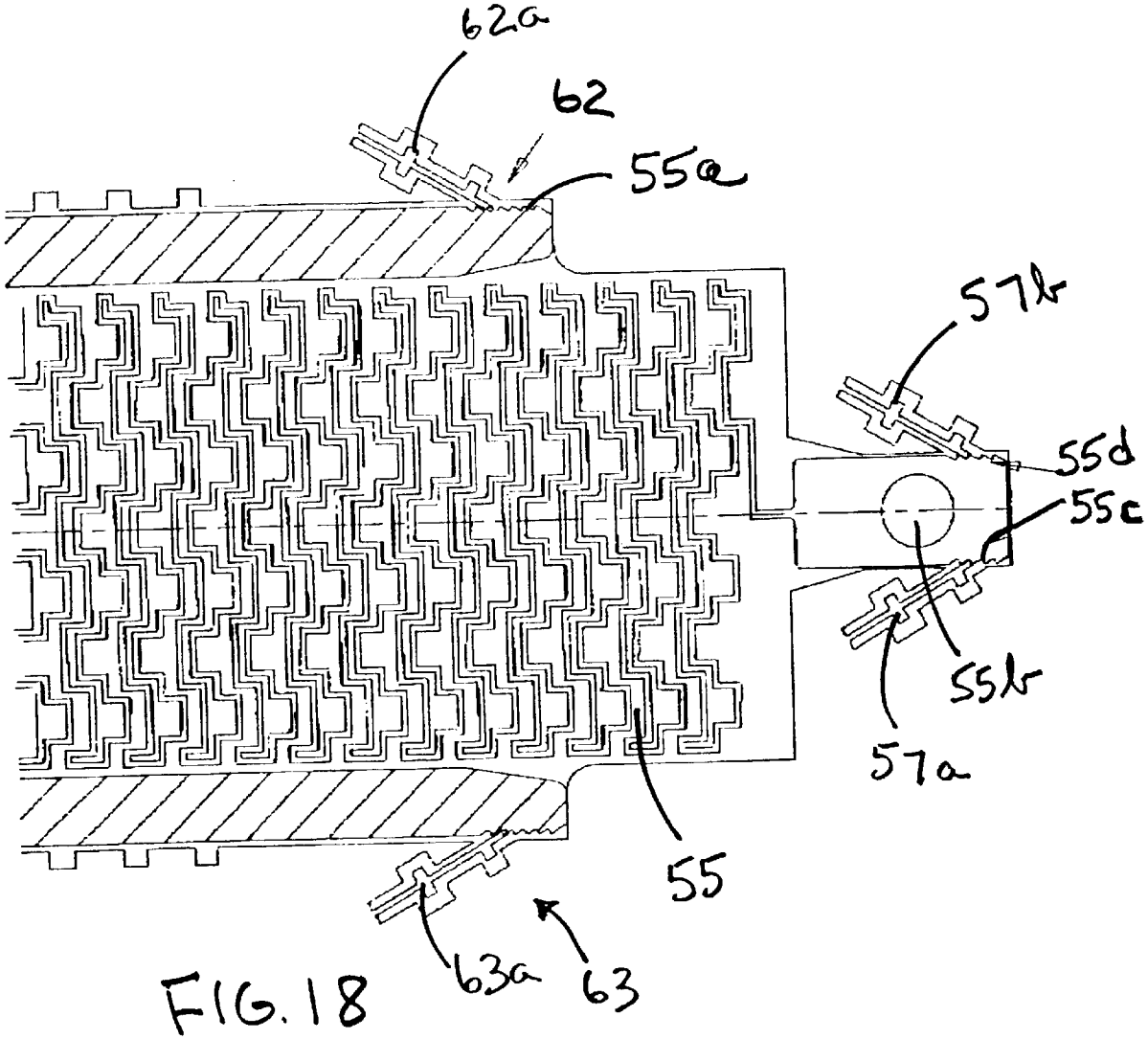
FIG. 18 is a diagrammatic representation of the arming slider of FIG. 17 in its latched position.

For this purpose, the head 55*a* is provided with barbs 55*c* and 55*d*, while the latch mechanism 57 is provided with latch fingers 57*a* and 57*b*. Accordingly, when the head 55*a* is manipulated to the right in FIG. 17 so as to move into the latch mechanism 57, the barbs 55*c* and 55*d* are engaged by the latch fingers 57*a* and 57*b*, respectively, thereby placing the arming slider spring 55 in its pre-biased or non-equilibrium position. This pre-biased or non-equilibrium position of arming slider spring 55 is shown in FIG. 18.

The salient features of the invention can be summarized as follows. The invention generally relates to the field of mechanical S&A devices for projectiles and munition fuze S&A devices involving exploitation of the micromachining, microscale device and MEMS technologies. As described above, the invention disclosed herein employs a rotor or slider to move out-of-line fire-train components toward and into an in-line position as arming proceeds, and the out-of-line element is, preferably, a detonator or squib (propellent initiator). Alternatively, the device of the present invention can function in such a manner that the rotor or slider removes an explosive barrier that has blocked functioning of the fire train, thereby arming the device.

As also mentioned above, the device of the present invention contains the heart of a mechanical fuze S&A device on a single die. Any solid material or combination of materials can be used to form the slider delay device of the present invention. In the preferred embodiment, the invention includes a slider and racks formed of metal (e.g., nickel) in a LIGA-MEMS fabrication process, but other micro-fabrication processes or other materials (including other metals or polymers, or even crystalline materials such as silicon or quartz) can be used. The material chosen is not central to the invention; what is central to the invention is that the material selection should enable the device to function as designed and as disclosed herein. It is envisioned that the device can be sandwiched between one or more other die that act together to implement arming and safety functions.

As previously mentioned, the arming slider of the invention may operate to remove a barrier that blocks transmission of fire train energy. The blocked or transmitted fire train energy controlled by the arming slider may, for example, be electrical (a spark), pyrotechnic (flame, pressure, temperature), electromagnetic (laser beam or LED output), inertial (flyer), magnetic, or whatever physical effect must be transmitted to effect munition activation.

It should be noted that, in accordance with the invention, a configuration is possible in which more than one detent (actuating slider) is operated upon by inertial loads. For example, the first slider might respond to setback acceleration in one axis and the another one or more of the sliders might respond to spin centrifugal acceleration in another axis. The point is that they both would operate in sequence in response to independent environmental inputs to remove physical locks from the arming slider to enable it to arm the fuze.

In addition, the height (relief) of the features is not especially important, given the fact that there is enough material for the sliders to interact in the intended manner. Current LIGA processes create features whose top surface is about 200-microns above the substrate, but the device may work just as well with only a 25- or 50- micron height. Any technology may be used to form the device, whether a LIGA-type process or a bulk plasm micromachining technique such as RIE (reactive ion etching), or a surface micromachining technique, or some other process yielding the desired configurations.

Preferably, the envisioned device is fabricated on a die approximately one square centimeter or less in area and about 500-microns thick. As mentioned above, preferably, the device is implemented on a single chip or die, but multiple dies can be employed as well. In a preferred embodiment of the invention, the device is monolithic in its basic configuration, but also, for practical purposes, can be sandwiched or stacked with another die. MEMS devices can be readily integrated and interfaced with electronics because they are fabricated much the same way as integrated circuits. The latter constitutes an advance of the present invention.

Preferably, the device is stackable in that the S&A die can be augmented by sandwiching it between other die or cover plates that add features or functions or provide data pickoff or porting of outputs.

In addition, the device is preferably designed and manufactured with high precision using microfabrication technology, based on optical masks. The device brings with it a high degree of precision, with features on a scale ranging from millimeters in dimension to microns in dimension.

As also previously mentioned, the required features may be created using any of a variety of micromachining techniques. The most likely fabrication technology for producing copies of the invention is the high-aspect-ratio (HAR) LIGA technique or other HAR bulk micromachining techniques, such as reactive ion etching (RIE) or the like, to create the intended features on a planar substrate.

Applications of the invention include, but are not limited to, safety and arming for projected pyrotechnics (including fireworks), flown instrumentation packages, and actuators for or in automotive impact sensing. The features and characteristics of the invention include, but are not limited to, development of a device which is planar so as to provide a size advantage, and especially a shape advantage, over traditional three-dimensional mechanical fuze devices and assemblies, provision of a device that does not or may not provide electrical power to function during the first arming stages, and the various other features and characteristics discussed and described herein.

In the latter discussion, the term "flown instrument packages" indicates an arrangement in which the device, instead of arming a fuze, closes a switch that initiates data recording aboard a tube-launched instrumentation package. The phrase "actuators for or in automotive impact sensing" indicates an application similar to the fuzing S&A application but, in the automotive environment, the zigzag slider responds to crash deceleration to work its way down the zigzag track, and it locks down when a certain change in velocity has occurred (with acceleration level above the threshold determined by the delay slider spring bias). Then, the "second environment" could be a mechanical switch that closes upon first impact, with the crushing of the vehicle structure, for example. That switch closing constitutes the second environment detection that fires the command slider. Command slider firing releases the pre-biased arming slider, and the arming slider closes a switch at its end of travel, and this fires an airbag or other automotive safety device. Thus, the present invention is not necessarily limited to fuzing S&A applications.

While preferred forms and arrangements have been shown in illustrating the invention, it is to be understood that various changes and modifications may be made without departing from the spirit and scope of this disclosure.

What is claimed is:

1. A safety and arming device for a projected munition, comprising:

delay slider means responsive to a given amount of acceleration of said projected munition for moving from an initial position to a final position;

arming slider means having an initial locked mode, and being responsive to movement of said delay slider means into said final position for assuming an unlocked mode, said arming slider means moving in a predetermined direction when in said unlocked mode; and command slider means interlockingly engaged with said arming slider means when said arming slider means is in said locked mode, and for partially disengaging from said arming slider means when said arming slider means moves in said predetermined direction.

2. The device of claim 1, wherein said command slider means is responsive to a predetermined command when partially disengaged from said arming slider means for moving in a direction away from said arming slider means so as to completely disengage from said arming slider means.

3. The device of claim 2, wherein said arming slider means moves further in said predetermined direction when said command slider means completely disengages from said arming slider means, whereby said arming slider means moves into a final position comprising an armed position thereof.

4. The device of claim 3, wherein said arming slider means comprises a squib initiator which is out of line with fire train elements of said projected munition when said arming slider means is not in said final position, and which is in line with said fire train elements of said projected munition when said arming slider means is in said final position.

5. The device of claim 1, wherein said delay slider means comprises a delay slider positioned in a zig-zag track for movement from said initial position to said final position, and a latch mechanism located at an end of a path of travel of said delay slider for latching said delay slider once said delay slider moves into said final position.

6. The device of claim 1, wherein said arming slider means comprises an arming slider positioned for movement in said predetermined direction from an initial position to a final position, and a latch mechanism located at an end of a path of travel of said arming slider for latching said arming slider when said arming slider moves into said final position.

7. The device of claim 1, wherein said delay slider means comprises a delay slider and a reset spring connected to an end of said delay slider for returning said delay slider to its initial position when acceleration of said projected munition is not sufficient to move said delay slider into said final position.

8. The device of claim 1, wherein said arming slider means comprises an arming slider and a slider spring connected to an end of said arming slider for moving said arming slider in said predetermined direction when said command slider means is completely disengaged from said arming slider means.

9. The device of claim 1, further comprising safety lock means located adjacent to said final position of said delay slider means and engaged with said arming slider means so as to lock said arming slider means in place until said delay slider means moves into said final position.

10. The device of claim 1, further comprising pre-biasing means for pre-biasing at least one of said delay slider means and said arming slider means.

11. The device of claim 10, wherein said delay slider means comprises a delay slider spring, and said pre-biasing means comprises a head fixed to an end of said delay slider spring and a latch mechanism into which said head is moved, said latch mechanism latching said head in a position corresponding to a pre-biasing of said delay slider spring.

12. The device of claim 10, wherein said arming slider means comprises an arming slider spring, and said pre-biasing means comprises a head fixed to an end of said arming slider spring and a latch mechanism into which said head is moved, said latch mechanism latching said head in a position corresponding to a pre-biasing of said arming slider spring.

13. The device of claim 1, wherein said safety and arming device is implemented in a planar micromachined device.

14. The device of claim 1, wherein said safety and arming device is implemented in a wafer chip.

15. The device of claim 1, wherein said arming slider means moves in said predetermined direction into an armed position, thereby moving explosive train elements into line with an arming circuit.

16. The device of claim 1, wherein said arming slider means moves in said predetermined direction into an armed position, thereby removing a barrier between fire train energy and an acceptor charge.

17. The device of claim 1, wherein said arming slider means moves in said predetermined direction into an armed position, thereby enabling a light source to pass unobstructed in order to arm said device.

18. The device of claim 17, wherein said light source comprises a laser beam delivered to said device.

19. The device of claim 1, wherein said arming slider means moves in said predetermined direction into an armed position under the influence of inertial forces associated with onboard spin of said projected munition.

20. The device of claim 1, wherein said arming slider means moves in said predetermined direction into an armed position under the influence of inertial forces derived from a set forward acceleration when said projected munition leaves a gun tube.

21. The device of claim 1, wherein said safety and arming device is used in one of projected pyrotechnics, a generalized payload, and an actuator for automotive impact sensing and actuation.

22. The device of claim 1, wherein said safety and arming device does not require electrical power during first stages of operation thereof.

* * * * *